114-242 SR
12/18/79 XR 4,178,706

United States Patent [19]
Boyce

[11] 4,178,706
[45] Dec. 18, 1979

[54] VEHICLE TOWED DISPLAY DEVICE

[76] Inventor: Robert A. L. Boyce, Ashwell Farm, Halwell, Totnes, Devon, England

[21] Appl. No.: 804,636

[22] Filed: Jun. 8, 1977

[51] Int. Cl.[2] ..... G09F 3/00
[52] U.S. Cl. ..... 40/326; 40/215; 114/242; 273/105.3
[58] Field of Search ..... 244/1 TD, 3, 152, 142, 244/143; 40/215, 326, 324; 273/105.3; 114/242, 243, 253

[56] References Cited

U.S. PATENT DOCUMENTS

| | | | |
|---|---|---|---|
| 803,084 | 10/1905 | Alexander | 40/326 |
| 1,332,274 | 3/1920 | Schlup | 40/326 |
| 1,901,855 | 3/1933 | Du Pont | 40/215 |
| 1,903,131 | 3/1933 | Picco | 40/215 |
| 2,153,940 | 4/1939 | Shorb | 40/215 |
| 2,194,869 | 3/1940 | Pike | 40/215 |
| 3,683,530 | 8/1972 | Robinson | 40/215 |

*Primary Examiner*—Louis G. Mancene
*Assistant Examiner*—Wenceslao J. Contreras
*Attorney, Agent, or Firm*—Watts, Hoffmann, Fisher & Heinke Co.

[57] ABSTRACT

A display device in which a banner towed behind a moving vehicle such as a boat, is stabilized by a self-regulating drogue parachute attached to the trailing end of the banner so as to maintain the banner in a vertical plane with its longitudinal axis substantially horizontal, for a wide range of air speeds. When not in use, the banner is wound onto a roller rotatably and removably mounted on a support carried by the vehicle.

26 Claims, 7 Drawing Figures

VEHICLE TOWED DISPLAY DEVICE

BACKGROUND TO THE INVENTION

The present invention relates to a display device for displaying a banner from a moving vehicle, particularly, but not exclusively, a boat.

It is known to display advertisements on banners trailed behind and usually below aircraft. For this purpose the banner is usually attached to the aircraft by a towrope and it may be of simple form as sufficient lift and drag may be obtained from the air moving over the banner itself to maintain the banner extended and flying in a substantially vertical plane. In some cases one or more wind socks have been trailed from the banner to provide further lift and drag. A towrope is not, however, a suitable attachment for a banner for use with a land or water vehicle as the leading end of the banner must be maintained above the surface on which the vehicle moves. Also, when used with a vehicle which travels at a substantially lower speed than aircraft, the movement of a simple banner becomes unstable. This may result in the banner dragging on the ground and tearing if towed from a car, or becoming waterlogged and sinking if towed from a boat. At best the advertisement can become so distorted as to be unreadable.

An object of the present invention is, therefore, to provide a display banner which can be trailed from a vehicle such as a boat or car.

SUMMARY OF THE INVENTION

According to the present invention there is provided a display device for towing behind a vehicle, comprising a banner having a leading edge, a trailing edge and two longitudinal edges, leading edge attachment means for attachment of said leading edge of the banner to said vehicle, and aerodynamically stable drogue means connected to said trailing edge of the banner at positions adjacent said longitudinal edges thereof, wherein said leading edge attachment means include a roller on which the banner may be wound when not in use and support means adapted to be mounted on the vehicle to support the roller above the surface on which the vehicle moves for rotation about its longitudinal axis with said axis substantially vertical, and wherein the drogue means provide sufficient lift and drag, when the banner is towed behind said vehicle, in use of said device, to maintain the banner in a substantially vertical plane with its longitudinal axis substantially horizontal.

The term "drogue means" as used in this specification is to be understood as including drogue parachutes, wind socks and kite devices, and may comprise two drogue parachutes, wind socks or kite devices, one attached to each of the said positions at the trailing edge of the banner.

Preferably the drogue means are releasably attached to the banner.

Preferably, the drogue means comprise a single drogue parachute consisting of an open-ended flexible sleeve having a leading end and a trailing end and provided at its leading end with shroud lines for connection to the banner.

The drogue parachute may have a mouth of larger diameter than the width of the banner and be connected directly to the trailing end of the banner. In a preferred embodiment of the invention, however, the drogue parachute is of any convenient size to maintain the banner extended horizontally in use, shroud lines being attached to a stay which is attached to the said positions at the trailing edge of the banner at two points on the stay separated by a distance at least equal to the distance between the said positions. The stay thus maintains the banner extended to its full width. The attachments of the shroud lines of the drogue parachute and of the trailing edge of the banner to the stay are preferably releasable.

Preferably, the shroud lines are divided into two groups, the groups being attached at vertically separated positions on the stay in use of the device. In this case hoisting means, readily accessible from the vehicle prior to release of the banner for display, may be provided for hoisting the upper attachment for the respective groups of shroud lines and/or the attachment for the uppermost of the opposite edges of the banner, in use of the banner, to the respective positions on the stay for use of the display device.

At least one rest, adapted for attachment to the support carried by the vehicle, is preferably provided for location and support of the stay when the banner is not in use.

A banner for use as part of the display device may be weighted at its lower edge, in use of the device, to maintain it in its correct orientation in flight, although in a preferred embodiment of the invention the lower end, in use, of the stay is weighted to help maintain the banner in a vertical plane during use.

Preferably, for use with a boat, a weight is provided at the lower end of the stay, the weight having a lower planing surface which will rebound from, or plane along the water surface if the trailing end of the banner drops temporarily due to a sudden change in the air speed over the device.

The stay preferably has sufficient buoyancy to prevent sinking of the device in event of detachment of the banner from the towing boat.

The banner is carried at its leading edge on a roller to facilitate unrolling of the banner from the vehicle prior to display and furling of the banner after the display. The banner is preferably releasably attached to the roller so that it can readily be interchanged with other banners to provide varying displays. The leading edge of the banner may, for example, be of enlarged thickness and slidable in a longitudinal slot in the support. Hoisting means may be provided to hoist the leading edge into the slot.

Preferably the support means for the roller include mounts adapted to engage the ends of the roller and in which the roller is releasably mounted for rotation about its longitudinal axis.

Manually or power operable means for rotating the roller about its axis to roll or unroll the banner are preferably also provided and one or each of the mounts may be provided with a guard to prevent the banner becoming entangled about the mount during rolling of the banner on to the roller. Alternatively, a guard may be provided at one or each end of the roller.

A rest for the location and support of the stay attached to the trailing end of the banner may be carried by each of the mounts for the roller, the upper and lower ends of the stay being located in a respective rest when the banner is stowed on the roller prior to, or after, display. One or each of the rests may be provided with a retaining catch to allow the respective end of the stay to enter the respective rest and be retained therein when the banner is stowed on the roller.

The mounts for the roller may be adapted for attachment to a wall of the towing vehicle but in preferred embodiments of the invention they are supported from a post carried by the vehicle. One or each of the mounts may be adjustable longitudinally of the post to alter the distances between the mounts to accommodate rollers of different lengths.

Duplicate upper and lower mounts may be provided adjacent those described above to hold a spare roller, either to allow rapid interchange of banners between displays, or alternatively, during use of a detachable banner carrying for example lettering, to allow rewinding of the banner from a first roller, after a first display run, on to the spare roller to reverse the lettering prior to a second display run in the opposite direction.

In a preferred embodiment of the invention the post supporting the mounts for the roller is pivotally mounted on the vehicle for pivotal adjustment about an axis substantially perpendicular to the plane of display of the banner. An adjustable stay is preferably connected to the post for pivoting it about the said axis into a desired position. The stay may, for example, be adjustable by means of a turnbuckle or may comprise an hydraulically- or electrically-operated, extensible arm which may be remotely controlled from the driving cab of the vehicle.

During display of the banner, the post will normally be set in a substantially upright position. Adjustment of the angle of the post is desirable during furling of the banner should the banner start to roll on to a greater width of the roller than its own width. If this is allowed to continue one edge of the banner will roll on to the respective roller mount and its support and become entangled. Adjustment of the angle of the post in an appropriate direction can realign the unfurled portion of the banner with that portion already on the roller and ensure that furling continues in a correct manner.

Adjustment of the angle of the post is also particularly desirable for use in connection with a boat in order to maintain the drogue means at a suitable angle to give the required lift at varying angles of plane of the boat.

A further problem arises during display of a banner from a moving vehicle due to changes in wind speed and direction which cause variations in the rate of flow of air both over the banner and through or over the drogue means. These variations affect the lift and drag provided by the drogue means and may cause distortion of the banner or result in movement of the axis of the banner out of the horizontal plane.

Compensation may be made for slight variation in air flow rate by providing a resilient attachment between the drogue means and the trailing end of the banner to allow automatic adjustment of the angle of inclination of the mouth of the drogue parachute to the horizontal during use of the device to help maintain the banner with its longitudinal axis substantially horizontal.

In order to compensate for greater variation in air flow such as occur on change in the direction of travel of the vehicle, a self-regulating drogue parachute is preferably used, having a leading opening of greater area than the rear opening, and provided with resilient means operable in flight of the drogue parachute to vary the effective area of the rear opening and hence the degree of lift and drag given by the drogue parachute in dependence upon the rate of air flow through the drogue parachute so as to provide a given degree of lift and drag substantially independently of the said rate of through flow of air.

In use of a device provided with such a self-regulating drogue parachute, air flowing through the parachute from the front to the rear end will tend to stretch the drogue to its fullest extent, the resilient means opposing the extension of the rear opening such that the latter is smaller for lower air rates. It can be arranged that air flowing through the drogue at lower speeds can thus produce similar effects of lift and drag to those produced by air flowing through the drogue at a higher speed, when the rear opening will be wider.

The resilient means may comprise at least one elastic element extending substantially around the periphery of the rear opening in which case the resilient means preferably comprise a single elastic element in the form of a continuous loop. Alternatively the resilient means may comprise a number of elastic elements extending across the rear opening. These elastic elements may, for example, be springs or lengths of a shock cord which consists of a rubber core encased in a sheath of woven nylon fibres.

Preferably the drogue parachute is provided with a plurality of rings spaced around the periphery of the rear opening and engaged by the elastic element or elements, in which case each elastic element may be provided at either end with, for example, a hook for engagement with a ring.

In a preferred embodiment of the invention the resilient means comprise at least one shock cord each of which passes through each of the rings and is joined to form a loop. Each shock cord may be passed only once around the periphery of the opening before being joined at its ends, or it may be coiled several times through the rings before being joined, depending on the resilience of the cord itself and the degree of stretch required for the particular drogue parachute.

It has been found that it is convenient if the ratio of the area of the front opening to that of the rear opening is variable by the resilient means between values of approximately 8.5:1, for lower air flow rates, to 2.5:1 for higher air flow rates.

BRIEF DESCRIPTION OF THE DRAWINGS

The invention will now be more particularly described, by way of example, with reference to the accompanying drawings, in which.

DETAILED DESCRIPTION OF THE ILLUSTRATED EMBODIMENTS

Figure 1:
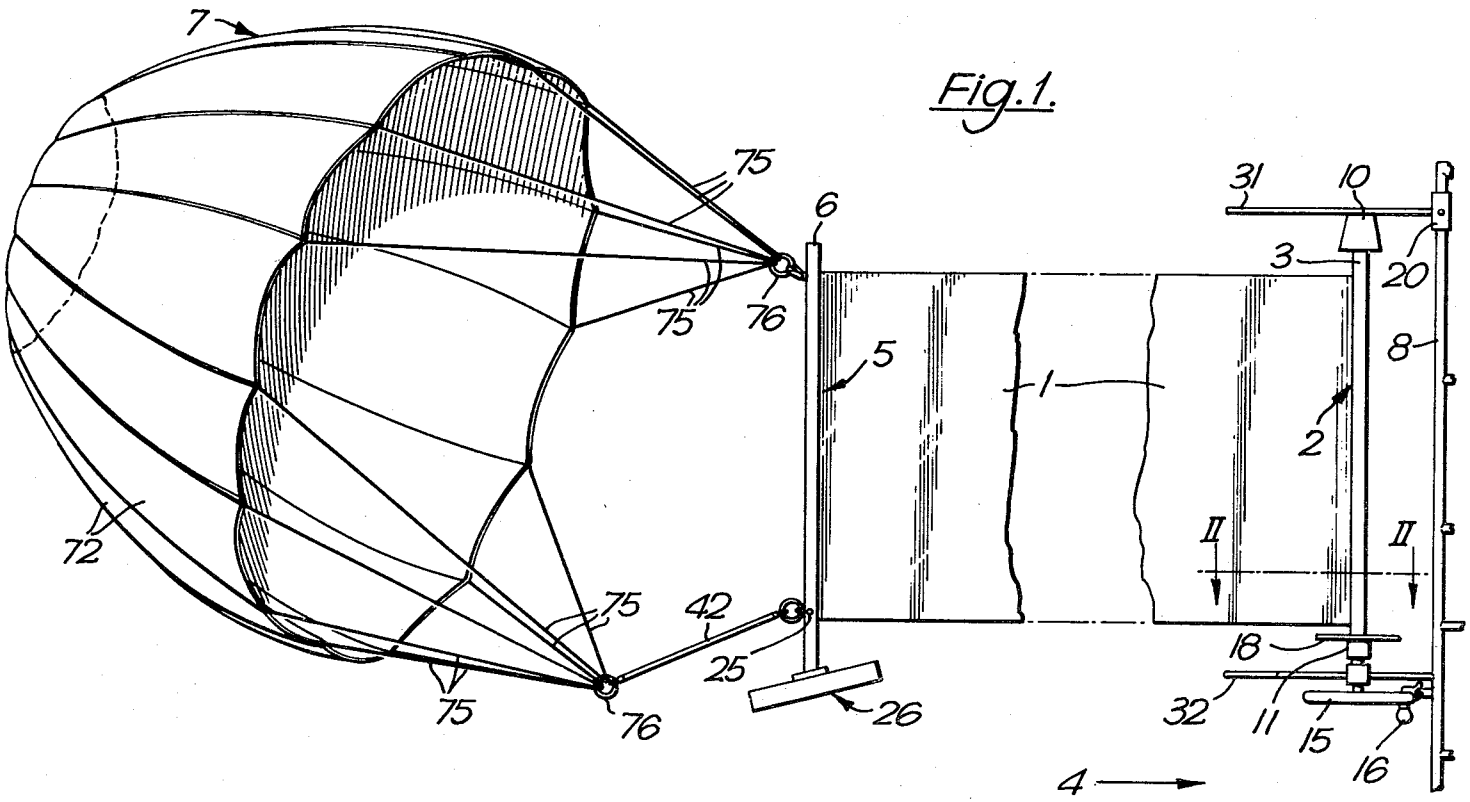
FIG. 1 is a diagrammatic side elevational view of a display device according to a first embodiment of the invention, showing the banner of the device extended, in use.

Referring to FIGS. 1 to 5 of the drawings, a display device according to the invention is shown including a banner 1 supported at a leading edge 2 from a boat moving in the direction of the arrow 4. A self-regulating drogue parachute 7 attached to the trailing end 5 of the banner 1 acts as a stabiliser to maintain the banner extended and flying in a substantially vertical plane with its longitudinal axis substantially horizontal, as shown.

The banner 1 is supported at its leading edge 2 by means of a roller 3 which is mounted at its ends in upper and lower mounts, 10 and 11 respectively, carried by a post 8 supported from the deck 47 of the boat.

Figure 2:
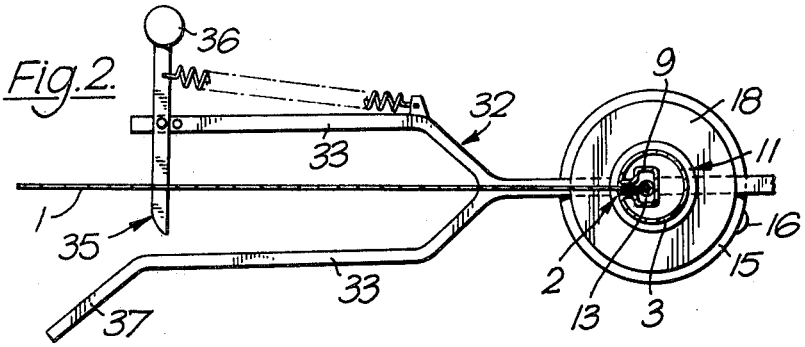
FIG. 2 is a sectional view on an enlarged scale taken on line II—II of FIG. 1 of part of the display device of FIG. 1.

As best seen in FIG. 2 the roller 3 comprises an aluminium tube of circular cross section having a longitudinal luff groove 9. The leading edge 2 of the banner 1 has a rope 13 sewn into a pocket formed by folding the banner 1 along the edge 2 and slides into the groove 9 to attach the banner 1 to the roller 3. Bolts 44 or other fastenings passed through corresponding holes in the roller 3 and the folded end of the banner retain the end of the banner in the groove 9.

The lower end of the roller 3 is removably located in the cup-shaped mount 11 and is retained by a manually-operable, spring loaded pin 14 which passes through corresponding holes in the mount 11 and roller 3. The mount 11 is rotatably supported from the post 8 and is rotatable by means of an aluminium wheel 15 and handle 16, the drive being transmitted to the roller 3 by the pin 14 to allow the banner 1 to be rolled on to, or unrolled from, the roller 3.

An annular washer 18, provided at the upper edge of the mount 11, prevents the banner from becoming entangled around the mount 11 during rolling. A catch 17, hinged to the post 8, can be hooked over an outer part of the wheel to prevent rotation of the wheel 15 as desired.

Figure 3:
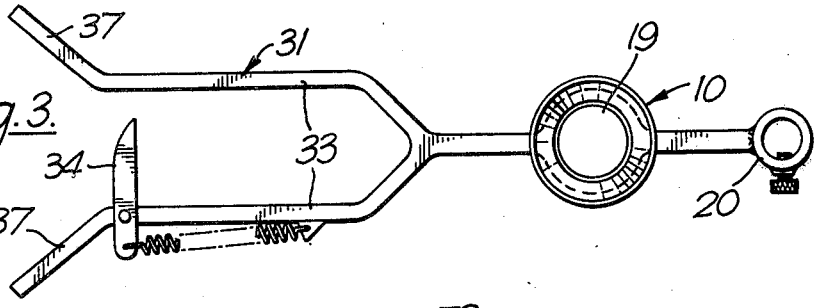
FIG. 3 is an under plan view on an enlarged scale of an upper mount and rest forming part of the display device of FIG. 1.

As shown in FIGS. 1 and 3, the upper mount 10 is frustoconical in shape, having an upper opening 19 of slightly greater diameter than the roller 3. The cone-shape acts as a guide for ease of location of the upper end of the roller in the mount 10, while the opening 19 allows the roller to be lifted sufficiently for its lower end to be located in the mount 11. The mount 10 is made from a low-friction plastics material and acts as a bearing for rotation of the roller, although in larger versions of the device additional bearings may be required.

The upper mount 10 is adjustably supported from the post 8 by means of a clamp 20 which allows adjustment of the height of the mount 10 above the mount 11 to accommodate rollers 3 of different lengths.

Figure 5:
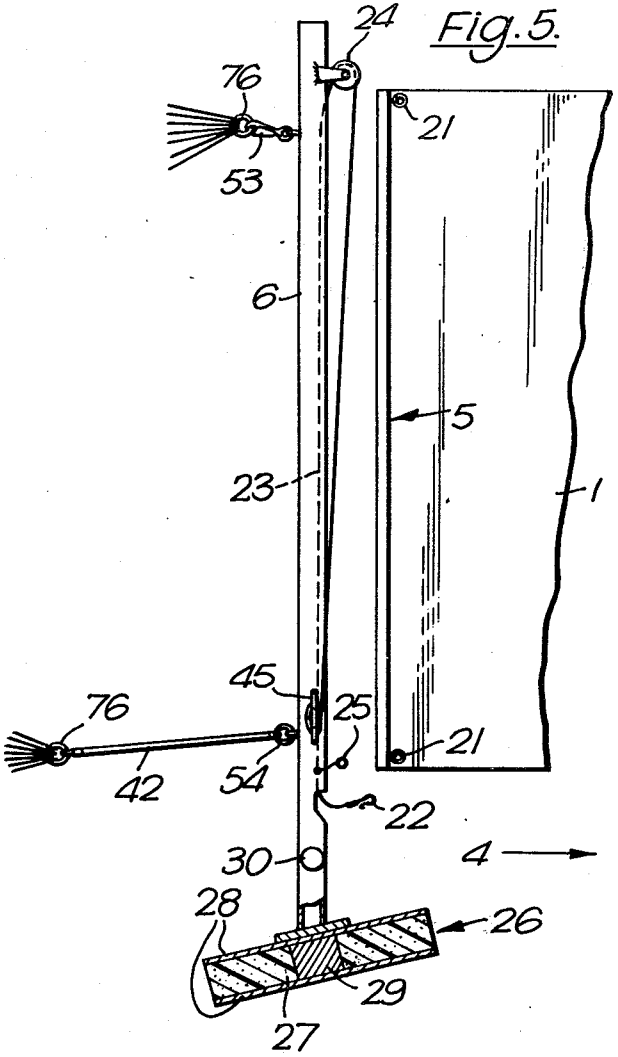
FIG. 5 is a part sectional view, on an enlarged scale, of a stay at the trailing edge of the banner of FIG. 1.

Referring to FIGS. 1 and 5 of the drawings, a stay 6 is provided at the trailing edge 5 of the banner 1 to which both the edge 5 of the banner 1 and the drogue parachute 7 are attached. The stay 6 is an aluminium tube of oval cross-section provided with a luff groove in a longitudinal leading edge similar to the groove 9 in the roller 3. The trailing edge 5 of the banner 1 is also strengthened by means of a rope sewn into a pocket similar to that at the leading edge and is provided with eyes 21 at its upper and lower corners. The edge 5 of the banner 1 can be pulled up into the groove in the stay 6 by means of a hook 22, which can be hooked into the upper eye 21, and which is attached to a cord 23 which passes over a pulley 24 at the upper end of the stay 6. The cord 23 is secured to a cleat 45 when the edge 5 is located in the groove, the lower end of the edge 5 also being secured by a pin 25 which is passed through a hole provided in the stay 6 and through the lower eye 21 in the banner.

In an alternative embodiment of the invention the stay 6 is of simple, oval cross-section and the trailing edge 5 of the banner is attached along its length to a rod or aluminium tube. The rod or tube is provided with hooks at least at its upper and lower ends, the stay being provided with corresponding eyes into which the hooks can be fitted to attach the banner to the stay. The hooks and eyes are preferably such that the uppermost hook can readily be engaged in its respective eye by a person standing on the deck of the boat, no pulley or other hoisting means being provided.

The lower end of the stay 6 is provided with a combined float and weight, generally indicated 26, shown in cross section in FIG. 5. The float comprises a polystyrene central portion 27, sandwiched between plywood boards 28 and is slanted upwardly in the direction of motion 4 of the display device. The lower board 28 thus acts as a planing surface which will skim over the water should the lower end of the stay momentarily drop to the water level during use.

A lead weight 29 is incorporated in the polystyrene float 27 to help maintain the stay 6 in the desired upright position during use. The float 27 prevents sinking of the banner 1 should it accidentally become detached from the boat, the hollow stay 6 also being sealed such that it acts as an additional float for the device.

Referring to FIGS. 1 to 3 of the drawings, upper and lower rests 31, 32 respectively for the stay are shown attached to the upper and lower mounts 10, 11 for the roller 3, for use when the banner 1 is rolled on the roller 3.

Each rest 31, 32 comprises a pair of arms 33 spaced apart by a distance slightly greater than the width of the stay 6. A lower part of the stay 6 above the weighted float 26 is provided, on either side, with rubber buffers 30 (see FIG. 5) which rest on the arms 33 of the lower rest 32 to retain the stay in the rest 32, the upper end of the stay being located between the arms 33 of the upper rest 31.

Spring loaded catches 34, 35 are provided at the open ends of the rests 31, 32 respectively. Each catch 34, 35 opens when a respective end of the stay is pressed against it to allow entry of the stay into the rest and is then closed under the action of its spring to retain the stay in the rest. The upper catch 34 is a non-return catch, but the lower catch 35 is manually operable by means of a knob 36. The catch 35 can thus be opened to allow the removal of the lower end of the stay 6 from the rest 32, the stay 6 being lowered to remove its upper end from the rest 31.

Outwardly extending guides 37 are provided for each rest 31, 32 to guide the respective end of the stay 6 into the rest 31, 32.

Other catches, releasable from the boat, for example by a bowden cable, could alternatively be employed.

Figure 4:
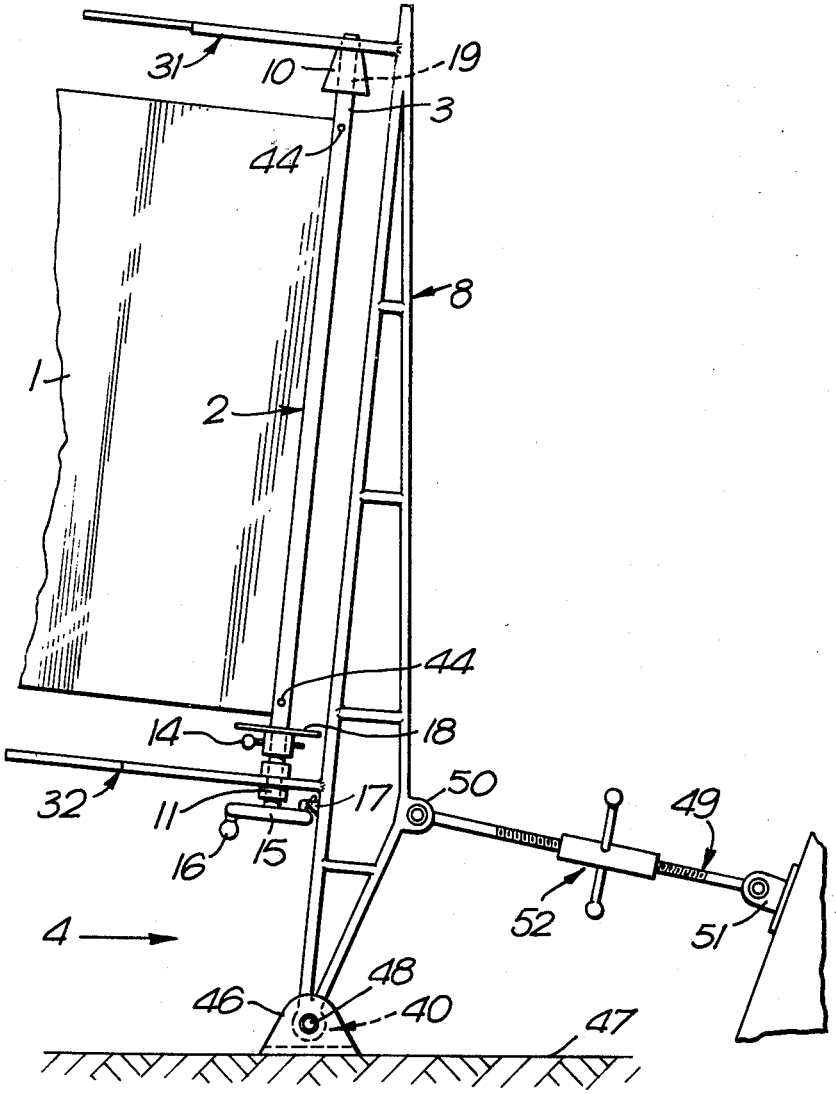
FIG. 4 is a side elevational view on an enlarged scale, of the leading edge of the banner of FIG. 1 and of its support.

Referring to FIG. 4 of the drawings, the post 8 comprises a tubular aluminium framework formed with an eye 40 at its lower end such that it can be mounted, as shown in FIG. 4, between a pair of lugs 46 fixed to a supporting deck 47 of a boat. A pin 48 passing through the eye 40 and corresponding holes in the lugs 46 secures the post 8 in position, the post 8 being pivotable about the axis of the pin 48 in a vertical plane substantially parallel to the direction of movement 4 of the boat.

The post 8 is maintained in a chosen position, normally upright, by means of an adjustable stay, 49, pivotally attached at one end to an anchorage 50 on the post and at the other end to a fixed anchorage 51 mounted on some convenient part of the boat. The stay 49 is adjustable by means of a turnbuckle, generally indicated 52, to shorten or lengthen the distance between the anchorage points 50, 51 and alter the angle between the post 8 and the deck 47. Such alteration of the angle of the post 8 is desirable to ensure that a banner 1 can be rolled correctly on to its roller 3.

Although the use of a stay 49, adjustable by means of a turnbuckle 52, has been described, other convenient means, such as an hydraulically-operated, extensible arm, could alternatively be employed for adjusting the angle of the post 8. Such means may be remotely operable by the pilot of the boat.

Figure 6:
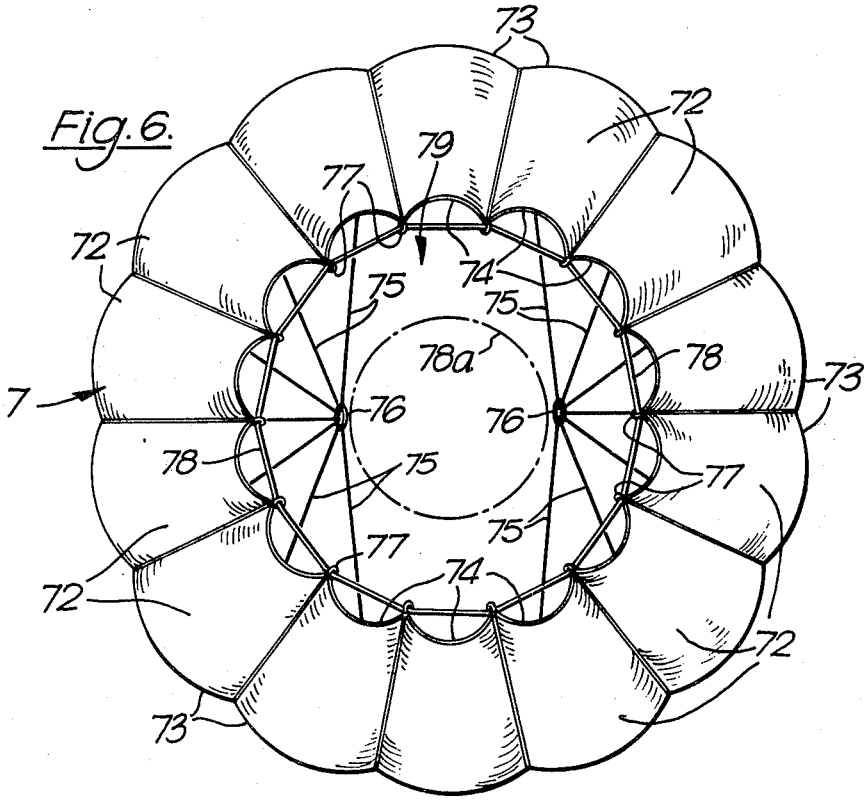
FIG. 6 is a rear end view of a self-regulating drogue parachute, for use with the device of FIG. 1.

The drogue parachute 7 is advantageously a self-regulating parachute as illustrated in FIG. 6 of the drawings. The parachute is made up from fourteen panels 72, each approximately 8½ feet long, 33 inches wide at a leading edge 73 and 17 inches wide at a trailing edge 74.

Shroud lines 75 are attached to the leading edges 73 of the panels 72, one at each junction between adjacent panels 72. The shroud lines 75 are subdivided into two groups of seven which are attached to respective stainless steel rings 76 for connection to the stay 6 as shown in FIG. 1.

Smaller stainless steel rings 77 are attached to the trailing edge 74 of the panels 2, one at each junction between adjacent panels 72. A shock cord 78, consisting of a rubber core sheathed in woven nylon passes through each ring 77 and is joined to form a continuous loop.

The shock cord 78 is shown extended substantially to its full extent such that the ratio of the area of the mouth of the drogue parachute 7, bounded by the leading edges 73 of the panels 72, to the area of the rear opening 79 of the drogue parachute 7, bounded by the rear edges 74 of the panels 72, is approximately 2.5:1. When the shock cord 78 is substantially slack it takes up the position shown in broken outline at 78*a*, the ratio of the above areas then being approximately 8.5:1. The shock cord 78 used in this embodiment requires a force of 40 lbs. wt. to stretch it to its fullest extent at which it has twice its normal, unstretched length.

Referring to FIG. 1 of the drawings, the upper ring 76 is releasably attached to an anchorage near the upper end of the stay 6 by means of a swivel spring hook 53, the lower ring 76 being connected to a spring hook 54, for releasable attachment to an anchorage near the lower end of the stay 6, by means of an extensible cord 42. The extensible cord 42 allows variation of the angle of the mouth of the drogue parachute 7 to the horizontal to compensate for variations in the air flow rate through the parachute 7.

In an alternative embodiment of the invention, (not shown), the attachment of the lower ring 76 to the stay 6 is inextensible while the attachment of the upper ring 76 to the stay 6 is by means of a halyard having an inextensible portion which passes over a pulley attached near the upper end of the stay 6 and an extensible portion which extends along the stay and is attached to the stay 6 near its lower end. The extensible portion may, for example, be a spring and the pulley and halyard system may be lowered to a suitable access position for engagement or disengagement of the drogue parachute 7.

In use of the display device the stay 6 is first located in the rests 31 and 32 while a roller 3, carrying a fully rolled banner 1, is placed in the mounts 10 and 11 and the strengthened trailing edge 5 of the banner 1 is hoisted into the luff groove in the stay 6 by means of the hook 22 and cord 23. The packed drogue parachute 7, is also attached by the hooks 53, 54 to the stay 6.

When the boat is moving forwards at a suitable speed the parachute is released from the stern and, due to the air flow, it will open, the front opening expanding substantially to its full extent. The air pressure also tends to extend the rear opening 79 to its full extent but the resulting tension in the shock cord 78 opposes this expansion and an equilibrium between the opposing forces is set up, defining the area of the rear opening. The stay 6 is then removed from its rests 31 and 32, the catch 17 is removed from the wheel 15 to allow it to rotate freely and the banner unrolls under the tension applied by the drogue parachute 7. The banner 1 should become taut and be maintained in a stable vertical plane with its axis horizontal because of the drag and lift afforded by the parachute.

Should the axis of the banner 1 tend to move out of a horizontal plane the deflection of the air moving through the drogue parachute 7 and the action of the extensible cord 42 should bring it back into the correct orientation. In flight the parachute will normally assume an attitude such that its upper part is slightly inclined towards the stay 6.

The self-regulating drogue parachute 7 is of particular use when displaying a banner from a boat travelling along a set course, both in an outward and a homeward direction, since the air flow rate through the parachute can differ greatly in the two directions on a windy day. If a non-self-regulating parachute were used, either the speed of the boat or the parachute itself must be changed on change of direction in order to provide the correct degree of lift and drag necessary to maintain the banner 1 with its axis substantially horizontal.

The self regulating drogue parachute operates as follows.

An increase in the air pressure on the drogue parachute 7 due to increase in the air speed through it, stretches the shock cord 78 to widen the rear opening 79. Since an increase in the size of the rear opening decreases the air resistance and lift given by the drogue parachute for a given air speed through it, this widening provides compensation for the increase in the air flow rate and it is found that the resistance and lift given by the above drogue parachute 7 are maintained substantially constant over a wide range of air speeds by the automatic regulation of the area of the rear opening 79 by the tension in the shock cord 78.

When it is wished to change the advertisement or other matter displayed, the banner 1 may be furled by rotation of the wheel 15 by means of the handle 16, and the roller 3 may be removed and replaced by a different roller without the parachute being taken in. The wheel 15 shown is hand operated, but alternatively motor operated means for rotating the roller could be employed.

Figure 7:
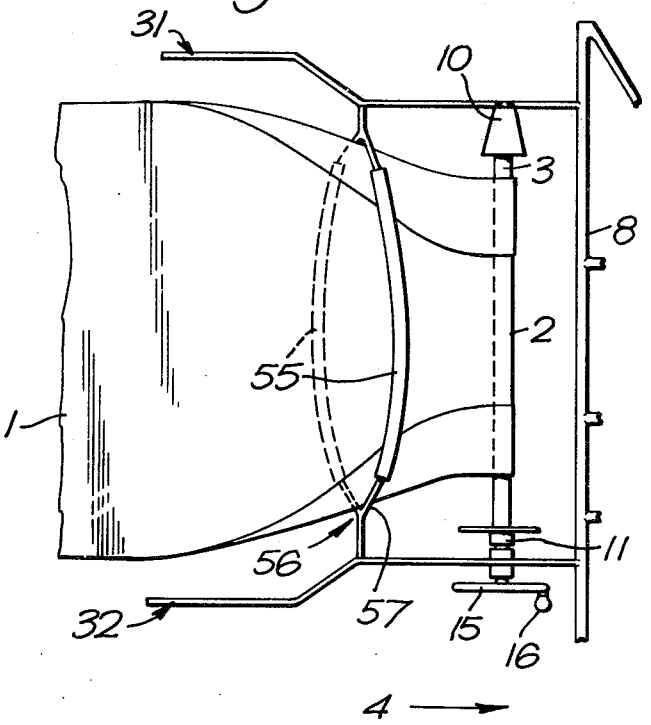
FIG. 7 is a side elevational view of the leading edge of a banner of a display device according to a second embodiment of the invention, and corresponding to FIG. 4.

FIG. 7 shows a second embodiment of the invention in which features corresponding to those of FIG. 1 are denoted by the same numerals.

In this embodiment, a banner 1 which is wider than the roller 3 is employed. The banner 1 is therefore folded lengthwise for attachment to, and rolling on, the roller 3. In this embodiment the roller 3 is a simple aluminium tube which is intelf inserted into a longitudinal pocket formed at the leading edge 2 of the banner.

Use of the folded banner of this embodiment, for the most part corresponds to that of the banner of the first embodiment. However, since, after use, the banner must again be folded lengthwise as it is rolled on to the banner, a guide generally indicated 48, is provided for this purpose.

The guide 56 is supported from the mounts 10 and 11 for the roller and comprises two V-shaped metal forks 57, joined together by bowed tubes 55 of plastics material forming an enclosed loop through which the banner passes. Since the end 2 of the banner attached to the roller 3 remains folded during use, as shown, the guide 56 ensures that as the rest of the banner is furled it will fold into the correct width for storage.

A longer stay 6 than that used in the first embodiment described is required for the wider banner 1 employed in this second embodiment, and therefore the rests 31 and 32 for the stay are in positions splayed outwardly from the guide 56, as shown. This also ensures that the banner 1 does not catch on the rests 31 and 32 in its extended position.

A display banner similar to that described above may be made for use with land vehicles. In this case there would be no need to provide a float 27 at the lower end of the stay 6. The weight 29 may be attached directly to the lower end of the stay and it may be advisable to provide a wheel or other protection at this end.

The embodiments shown employ a drogue parachute having an opening of greater diameter than the width of the banner and are suitable for use at air speeds of the order of 30 m.p.h. For higher air speeds a much narrower parachute, tending towards the shape of a wind sock, or a smaller parachute of substantially the same relative dimensions as that shown in FIG. 1, could be used.

The embodiments of the display device described above are self-stabilising but control means for the drogue parachute, operable from the vehicle may be incorporated. For example at least one panel of the drogue parachute may be provided with an opening closable by a flap or otherwise variable in effective area by a control line extending to the vehicle.

In an alternative embodiment of the invention the post 8 for supporting the mounts 10, 11 is a fixed mast, maintained in an upright position by means of stays, the roller 3 being supported for pivotal movement relative to the post in the plane of display of the banner. The lower mount 11 may, for example, be connected to the mast 8 by an adjustable linkage which can be adjusted to vary the distance between the mount 11 and the mast 8, the upper mount 10 being pivotable relative to the mast such that adjustment of the position of the lower mount 11 pivots the roller about its upper end. The roller may be pivotable through an angle of about 7° on either side of its normal vertical position.

I claim:

1. A display device for towing behind a vehicle, comprising:

a banner having a leading edge, a trailing edge and two longitudinal edges;

leading edge attachment means for attachment of said leading edge of the banner to said vehicle, including a roller on which the banner may be wound when not in use and support means adapted to be mounted on the vehicle to support the roller above the surface over which the vehicle moves, for rotation about its longitudinal axis with said axis substantially vertical;

a stay attached to said trailing edge of said banner at positions adjacent said longitudinal edges thereof to maintain said trailing edge extended, in use;

aerodynamically stable drogue means comprising an open-ended, flexible sleeve having a leading end and a trailing end, and means connecting said leading end of said drogue means to said stay such that the upper portion, in use of said device, of said leading end is closer to said stay than the lower portion of said leading end, said drogue means providing sufficient lift and drag to maintain said towed banner in a substantially vertical plane with its longitudinal axis substantially horizontal.

2. A display device as in claim 1, wherein said banner is releasably attached to said stay.

3. A display device as in claim 2, wherein hoisting means, readily accessible from the vehicle are provided for hoisting the uppermost attachment at the trailing edge of said banner, in use of said banner, to its position on said stay for use of said device.

4. A display device as in claim 1, wherein at least one rest, adapted for attachment to said support carried by said vehicle, is provided for location and support of said stay when said banner is not in use.

5. A display device as in claim 1, wherein the lower end, in use, of said stay is weighted to help maintain said banner in a vertical plane during use.

6. A display device as in claim 1, wherein said support means for said roller include mounts adapted to engage the ends of the roller and in which the roller is releasably mounted for rotation about its longitudinal axis.

7. A display device as in claim 6, wherein means are provided for rotating said roller about its axis at least to roll the banner on to the roller.

8. A display device as in claim 7, wherein at least one of said mounts is provided with a guard to prevent the banner becoming entangled about the mount during rolling of the banner on to the roller.

9. A display device as in claim 6, wherein each mount for said roller carries a rest in which the upper and lower end respectively of the said stay can be located when the banner is stowed on the roller.

10. A display device as in claim 9, wherein at least one of said rests is provided with a retaining catch to allow the respective end of said stay to enter the respective rest and be retained therein when the banner is stowed on the roller.

11. A display device as in claim 6, wherein said support means for said roller further include a post carried by said vehicle for display of said banner, from which said mounts are supported.

12. A display device as in claim 11, wherein at least one of said mounts is adjustable longitudinally of said post to alter the distances between said mounts to accommodate rollers of different lengths.

13. A display device as in claim 1, wherein said leading opening of said drogue means is of greater area than said rear opening, and wherein resilient means are provided which are operable in flight of said drogue means to vary the effective area of said rear opening and hence the degree of lift and drag given by said drogue means in dependence upon the rate of air flow through said drogue means so as to provide a given degree of lift and drag substantially independently of said rate of through flow of air.

14. A display device as in claim 13, wherein said resilient means comprise at least one elastic element extending substantially around the periphery of said rear opening.

15. A display device as in claim 14, wherein said drogue means is provided with a plurality of rings spaced around the periphery of said rear opening and engaged by said at least one elastic element.

16. A display device as in claim 15, wherein said resilient means comprise a single elastic element in the form of a continuous loop.

17. A display device as in claim 1, wherein said means connecting said leading end of said drogue means to said stay in releasable.

18. A display device as in claim 1, wherein said means connecting said leading end of said drogue means to said stay includes shroud lines attached to said leading end and divided into two groups and upper and lower connection means connecting the respective said groups to said stay at upper and lower positions on said stay respectively, said lower connection means being longer than said upper connection means.

19. A display device as in claim 18, wherein said lower connection means is resilient to allow automatic adjustment of the angle of inclination of the mouth of said drogue means to the horizontal during use of said device to help maintain said banner with its longitudinal axis substantially horizontal.

20. A display device for towing behind a boat, comprising:

a banner having a leading edge, a trailing edge and two longitudinal edges;

leading edge attachment means for attachment of said leading edge of the banner to said vehicle, including a roller on which the banner may be wound when not in use and support means adapted to be mounted on the vehicle to support the roller above the surface on which the vehicle moves, for rotation about its longitudinal axis with said axis substantially vertical;

a stay attached to said trailing edge of said banner at positions adjacent said longitudinal edges thereof to maintain said trailing edge extended, in use;

a weight provided at the lower end of said stay to help maintain said stay vertical, in use, said weight having a lower planing surface which will plane along the water surface; and aerodynamically stable drogue means connected to said stay, whereby, in use of said device with said banner being towed behind said boat, said drogue means provide sufficient lift and drag to maintain said banner in a substantially vertical plane with its longitudinal axis substantially horizontal.

21. A display device as in claim 20, wherein said stay has sufficient buoyancy to prevent sinking of said device, in event of detachment of said banner from said towing boat.

22. A display device for towing behind a vehicle, comprising a banner having a leading edge, a trailing edge and two longitudinal edges, leading edge attachment means for attachment of said leading edge of the banner to said vehicle, and aerodynamically stable drogue means connected to said trailing edge of the banner at positions adjacent said longitudinal edges thereof, wherein said leading edge attachment means include a roller on which the banner may be wound when not in use and to which said banner is releasably attached and support means adapted to be mounted on the vehicle to support the roller above the surface on which the vehicle moves for rotation about its longitudinal axis with said axis substantially vertical, and wherein the drogue means provide sufficient lift and drag, when the banner is towed behind said vehicle in use of said device, to maintain the banner in a substantially vertical plane with its longitudinal axis substantially horizontal.

23. A display device as in claim 22, wherein said leading edge of the banner is of enlarged thickness, and said roller is provided with a longitudinal slot in which said enlarged edge is slidable.

24. A display device for towing behind a vehicle, comprising:

a banner having a leading edge, a trailing edge and two longitudinal edges;

a roller to which said leading edge of said banner is attached and on which the banner may be wound when not in use;

mounts adapted to engage the ends of said roller and in which the roller is releasably mounted for rotation about its longitudinal axis;

a post carried by said vehicle for display of said banner from which said mounts are supported to support the roller above the surface on which the vehicle travels with its longitudinal axis substantially vertical, said post being pivotally mounted on the vehicle for pivotal adjustment about an axis substantially perpendicular to the planes of display of the banner, and aerodynamically stable drogue means connected to said trailing edge of said banner at positions adjacent said longitudinal edges thereof, whereby, in use of said device with said banner being towed behind said vehicle, said drogue means provide sufficient lift and drag to maintain said banner in a substantially vertical plane with its longitudinal axis substantially horizontal.

25. A display device as in claim 24, wherein an adjustable stay is connected to said post for pivoting the post about said axis into a desired position.

26. A display device for towing behind a relatively low speed vehicle comprising:

(a) an elongated display banner towed in a substantially vertical plane behind a vehicle;

(b) banner stowage means attached to the vehicle and connected to a leading end of the banner, said stowage means including structure for releasing said banner for towing and retrieving the towed banner for storage; and, (c) towed banner stabilizing means comprising lift creating means for providing lifting forces when towed at relatively low speed and connecting means for connecting the lift creating means to the trailing end of said banner, said connecting means effective to transmit lifting forces from said lift creating means to said banner trailing end while maintaining said banner substantially in said plane.

* * * * *